US011486232B2

(12) United States Patent
Li et al.

(10) Patent No.: US 11,486,232 B2
(45) Date of Patent: Nov. 1, 2022

(54) METHOD AND DEVICE FOR EXPLOITING NATURAL GAS HYDRATE FROM MARINE ROCK

(71) Applicant: GUANGZHOU INSTITUTE OF ENERGY CONVERSION, CHINESE ACADEMY OF SCIENCES, Guangzhou (CN)

(72) Inventors: Xiaosen Li, Guangzhou (CN); Pengfei Shen, Guangzhou (CN); Gang Li, Guangzhou (CN); Zhaoyang Chen, Guangzhou (CN); Yu Zhang, Guangzhou (CN); Yi Wang, Guangzhou (CN); Jianwu Liu, Guangzhou (CN)

(73) Assignee: GUANGZHOU INSTITUTE OF ENERGY CONVERSION, CHINESE ACADEMY OF SCIENCES, Guangzhou (CN)

( * ) Notice: Subject to any disclaimer, the term of this patent is extended or adjusted under 35 U.S.C. 154(b) by 217 days.

(21) Appl. No.: 16/647,887

(22) PCT Filed: Nov. 19, 2019

(86) PCT No.: PCT/CN2019/119412
§ 371 (c)(1),
(2) Date: Mar. 17, 2020

(87) PCT Pub. No.: WO2021/092978
PCT Pub. Date: May 20, 2021

(65) Prior Publication Data

US 2021/0404295 A1 Dec. 30, 2021

(30) Foreign Application Priority Data

Nov. 14, 2019 (CN) ..... 201911114181.X

(51) Int. Cl.
*E21B 41/00* (2006.01)
*E21B 43/02* (2006.01)
(Continued)

(52) U.S. Cl.
CPC ..... *E21B 41/0099* (2020.05); *E21B 36/005* (2013.01); *E21B 41/0078* (2013.01);
(Continued)

(58) Field of Classification Search
CPC ..... E21B 41/0099; E21B 43/02
See application file for complete search history.

(56) References Cited

FOREIGN PATENT DOCUMENTS

CN 108505977 A * 9/2018 ..... E21B 36/005
WO WO-9208036 A1 * 5/1992 ..... E21B 17/206

* cited by examiner

*Primary Examiner* — Robert E Fuller
(74) *Attorney, Agent, or Firm* — Bayramoglu Law Offices LLC

(57) ABSTRACT

An exploiting method and device of marine facies natural gas hydrate. The exploiting method comprises the following steps: (1) after the construction of a vertical well, a fixed pipe is constructed, the exploiting well is set in the center of the fixed pipe, and the mixture is filled between the inner wall of the fixed pipe and the outer wall of the exploiting well; (2) the self-excited oscillating jet nozzle enters the exploiting well along the vertical well to the designated position through an orifice on the exploiting well and sprays the mixture, so that the mixture is broken evenly to form artificial fractures; (3) under the corresponding temperature, the hydrate decomposes to produce gas by depressurized exploiting; (4) the gas-liquid mixture exploited by the exploiting well is separated into liquid and gas in the gas-liquid separation device to collect liquid and gas.

6 Claims, 2 Drawing Sheets

(51) Int. Cl.

| | |
|---|---|
| ***E21B 47/06*** | (2012.01) |
| ***E21B 36/00*** | (2006.01) |
| ***E21B 43/38*** | (2006.01) |
| ***E21B 47/07*** | (2012.01) |

(52) U.S. Cl.
CPC ..... *E21B 43/02* (2013.01); *E21B 43/38* (2013.01); *E21B 47/06* (2013.01); *E21B 47/07* (2020.05)

METHOD AND DEVICE FOR EXPLOITING NATURAL GAS HYDRATE FROM MARINE ROCK

CROSS REFERENCES TO THE RELATED APPLICATIONS

This application is the national phase entry of International Application No. PCT/CN2019/119412, filed on Nov. 19, 2019, which is based upon and claims priority to Chinese Patent Application No. 201911114181.X, filed on Nov. 14, 2019, the entire contents of which are incorporated herein by reference.

TECHNICAL FIELD

The present invention belongs to the technical field of energy, particularly to an exploiting method and device of marine facies natural gas hydrate.

BACKGROUND

Natural gas hydrate is a kind of ice like crystal substance formed by natural gas and water under high pressure and low temperature. Because it looks like ice and can be burned in case of fire, it is also known as "combustible ice". It has high resource density, wide global distribution and high resource value. It is considered to be one of the most promising new energy sources that can replace other fossil energy such as oil. On Nov. 3, 2017, the State Council officially approved the listing of natural gas hydrate as a new mineral species, becoming the 173th mineral species in China. The depressurized exploiting method of natural gas hydrate is a kind of exploiting method which can decrease the pressure of the hydrate reservoir and destroy the equilibrium and stability of the hydrate phase to promote its decomposition. It is the most promising one of all exploiting methods, so it may become one of the effective methods for large-scale exploitation of natural gas hydrate in the future. In 2013, combustible ice was exploited from the sea floor at a depth of 1000 meters, 70 km south of the WaMu Peninsula in Aichi County. Within six days, 120000 cubic meters of natural gas was successfully exploited, making Japan the first country in the world to exploit the combustible ice on the sea floor. The main reason for the end of the six-day exploitation is that the sediment blocked the drilling channel, resulting in the blockage of the exploiting pipes and the failure of gas production. On Mar. 28, 2017, China began to drill the first trial-produce well in Shenhu sea area in the north of the South China Sea, 320 km southeast of Zhuhai City. At 14:52 p.m. on May 10, the fire was successfully ignited, and natural gas was exploited from the gas hydrate deposit with a depth of 203-277 m under the sea floor at a depth of 1266 meters. By the afternoon of June 10, the total gas production of trial exploitation had reached 210000 $m^3$ with an average daily production of 6800 $m^3$, achieving a number of major breakthroughs, such as long-term natural gas production, stable air flow and environmental safety. For the two times of exploitation of natural gas hydrate reservoir on the sea floor, all of the methods adopted were depressurized exploiting which had the problems, e.g. the exploiting pipes were blocked by seabed sediment, the exploiting efficiency was low.

After deeply analyzing the reasons for the low exploiting efficiency of marine facies sediments with low permeability, it is found that the method of depressurized exploiting relies on the pressure decrease to destroy the phase equilibrium conditions of natural gas hydrate, resulting in the decomposition of hydrate. However, for the marine facies sediments with low permeability, the traditional hydraulic fracturing cannot improve the permeability of the reservoir because the fractures caused by hydraulic fracturing are quickly filled and sealed by the extremely fine particles such as silt and sand, and the permeability of the hydrate reservoir determines the success or failure of depressurized exploiting. At the same time, a large number of studies show that the increase of depressurization causes the formation of a large number of secondary hydrate. Therefore, how to improve the permeability of reservoir, ensure that it is not blocked by sediment and inhibit secondary hydrate formation become the key to the depressurized exploiting of marine facies natural gas hydrate.

SUMMARY

The purpose of the present invention is to overcome the shortcomings of the prior art and provide an exploiting method and device of marine facies natural gas hydrate. The exploiting method proposed in the present invention can realize automatic operation and remote control, effectively prevent the sand production of exploiting pipes, improve permeability around exploiting pipes, inhibit secondary hydrate formation in exploiting pipes, realize stable depressurized exploiting, improve exploiting efficiency and recovery of high concentration natural gas.

The purpose of the present invention is to provide an exploiting method of marine facies natural gas hydrate, comprises the following steps:

(1) Construction of artificial sand control well wall: when exploiting a hydrate production area, the construction of a vertical well is completed first. After the vertical well reaches the hydrate layer, a fixed pipe (e.g., casing) is set in the hydrate layer, and an exploiting pipe (e.g., production tubing) is set in the center of the fixed pipe. The well-mixed adhesive mixture of hydrophobic porous material and inorganic permeable concrete reinforcing agent (e.g., cement) is filled between the inner wall of the fixed pipe and the outer wall of the exploiting pipe (e.g., annulus) is to form an artificial sand control well wall;

(2) artificial sand control well wall with hydraulic jet permeability enhancement: the self-excited oscillating jet nozzle enters the exploiting pipe seated in the fixed pipe along the vertical well and to the designated position through the orifice on the exploiting pipe and sprays the mixture, so as to break the adhesive formed mixture evenly and form artificial fractures;

(3) Depressurized exploiting: under the corresponding temperature, when the exploiting pressure is lower than the natural gas hydrate phase equilibrium pressure, the hydrate decomposes to produce gas. An intelligent control system judges the start and stop of a temperature rise device (e.g., heater) and an inhibitor circulation device according to the conditions of a temperature sensor and a pressure sensor. When the corresponding point of the temperature and pressure measured by the temperature sensor and the pressure sensor is under the level of the natural gas hydrate phase equilibrium, the temperature rise device and inhibitor circulation device start automatically. The temperature rise device heats the outer layer of the fixed pipe continuously. The inhibitor nozzle in the inhibitor circulation device sprays out the inhibitor to the wellhead of the exploiting pipe to inhibit secondary hydrate formation on the outer layer of the fixed pipe and within the well;

(4) Gas liquid separation: the gas-liquid mixture extracted from the exploiting pipe is separated in the gas-liquid separation device to obtain liquid and gas. The liquid is discharged from the discharge port to the upper mud layer and the gas is discharged from the gas outlet along the vertical well to the gas booster chamber. When the pressure is higher than the set pressure, the gas rises to an offshore platform to complete gas collection.

In Step (1), the diameter of the fixed pipe is determined by the seepage condition of the hydrate layer. The constructed fixed pipe is filled with hydrophobic porous material and inorganic permeable concrete reinforcing agent, which are evenly mixed to fill the whole fixed pipe and adhesive formed. The purpose of this step is to use the pores of hydrophobic porous material to discharge the gas and liquid produced by decomposing to block the sea mud outside the fixed pipe. The purpose of artificial fractures in Step (2) is to improve the permeability and gas production efficiency around the exploiting pipe.

The purpose of artificial fractures in Step (2) is to improve the permeability and gas production efficiency around the exploiting well.

In Step (3), under the corresponding temperature, when the exploiting pressure is lower than the natural gas hydrate phase equilibrium pressure, the hydrate decomposes to produce gas. As the temperature around the hydrate is decreased due to the decomposition process, the natural gas hydrate phase equilibrium pressure is also decreased, which leads to the secondary hydrate formation easily appearing in the exploiting pipe and on the fixed pipe wall, resulting in the blockage of the pipe body. Therefore, an intelligent control system is adopted. The intelligent control system can judge the start and stop of the temperature rise device and the inhibitor circulation device according to the conditions of the temperature sensor and the pressure sensor. When the corresponding point of the temperature and the pressure is under the level of the natural gas hydrate phase equilibrium, the temperature rise device and inhibitor circulation device start automatically to continuously heat the outer layer of the fixed pipe, and the inhibitor is sprayed out to the wellhead of the exploiting pipe to effectively inhibit the secondary hydrate formation on the outer layer of the fixed pipe and within the well.

Preferably, the mass ratio of the hydrophobic porous material and the inorganic permeable concrete reinforcing agent in the mixture of the hydrophobic porous material and the inorganic permeable concrete reinforcing agent is 1000:1-10:1.

Preferably, the exploiting pipe is vertical or horizontal.

The present invention also protects the exploiting device of marine facies natural gas hydrate of the exploiting method of marine facies natural gas hydrate, it comprises an artificial sand control well wall system, a hydraulic jet permeability enhancement system, a depressurized exploiting system and a gas-liquid separation control system; the artificial sand control well wall system comprises a fixed pipe buried in a hydrate layer, the hydraulic jet permeability enhancement system comprises a self-excited oscillating jet nozzle; the depressurized exploiting system comprises a vertical well, an exploiting pipe arranged in the center of the fixed pipe, a temperature rise device arranged outside the fixed pipe and an inhibitor circulation device arranged outside the fixed pipe, the inhibitor circulation device comprises an inhibitor nozzle arranged outside the exploiting pipe and an inhibitor recovery bin arranged outside the fixed pipe, the self-excited oscillating jet nozzle enters the exploiting pipe of the fixed pipe along the vertical well to the designated position through the orifice on the exploiting pipe and sprays the mixture, so as to break the mixture evenly and form artificial fractures; the gas-liquid separation control system comprises a gas-liquid separation device, a gas booster chamber and an intelligent control system which judges the start and stop of the temperature rise device and the inhibitor circulation device according to the conditions of the temperature sensor and the pressure sensor arranged outside the fixed pipe. The gas-liquid mixture extracted from the exploiting pipe is separated in the gas-liquid separation device to obtain liquid and gas. The liquid is discharged from the discharge port to the upper mud layer and the gas is discharged from the gas outlet along the vertical well to the gas booster chamber. When the pressure is higher than the set pressure, the gas rises to the offshore platform to complete gas collection.

Preferably, the inner layer filter screen and the outer layer filter screen are arranged outside the exploiting pipe to prevent the extremely fine particles from mixing into the horizontal exploiting pipe, and the inner layer filter screen and the outer layer filter screen are both provided with orifices for the inflow of gas-liquid mixture.

Further preferably, the temperature rise device is a heating wire, which is uniformly arranged on the outer layer of the fixed pipe. When the corresponding point of the temperature and pressure measured by the temperature sensor and the pressure sensor is under the level of the natural gas hydrate phase equilibrium, the heating wire heats the outer layer of the fixed pipe continuously to break the hydrate formed on the outer layer of the fixed pipe, ensuring that the gas enters the exploiting pipe from the orifice of the exploiting pipe.

The outer layer of the fixed pipe is evenly arranged with heating wires. The intelligent control system can judge the start and stop of the temperature rise device according to the conditions of the temperature sensor and the pressure sensor. When the corresponding point of the temperature and the pressure is under the level of the natural gas hydrate phase equilibrium, the temperature rise device automatically starts to continuously heat the outer layer of the fixed pipe to break the hydrate formed on the outer layer of the fixed pipe, ensuring that the gas enters the exploiting pipe from the orifice; the gas-liquid mixture extracted from the exploiting pipe is separated in the gas-liquid separation device. The liquid is discharged from the discharge port to the upper mud layer and the gas is discharged from the outlet along the vertical well to the gas booster chamber. When the pressure is higher than the set pressure, the gas rises to an offshore platform.

Preferably, a mixture of hydrophobic porous material and inorganic permeable concrete reinforcing agent is filled between the inner wall of the fixed pipe and the outer wall of the exploiting pipe. Hydrophobic porous materials have no affinity to water and gather into blocks in water. Inorganic permeable concrete reinforcing agent reacts with hydrophobic porous materials to form polymer hydrate which is not easy to be dispersed by water, which greatly improves the compressive strength and adhesive strength of hydrate, and enhances the freeze-thaw resistance, durability and weather resistance of hydrophobic porous materials.

The fixed pipe is buried in the hydrate layer in advance, and the exploiting pipe is set inside the fixed pipe. The hydrophobic porous material from the hydrophobic porous material bin is mixed with the inorganic permeable concrete reinforcing agent from the inorganic permeable concrete reinforcing agent tank and then it enters the vertical well to fill between the outer wall of the exploiting pipe and the inner wall of the fixed pipe, which is adhesive formed by the inorganic permeable concrete reinforcing agent; the self-excited oscillating jet nozzle can move directionally in the fixed pipe and the exploiting pipe, and can reach the designated position according to the demand to spray the hydrophobic porous material, so that the hydrophobic porous material adhesive formed with the inorganic permeable concrete reinforcing agent can be broken evenly, forming artificial fractures; the inhibitor circulation device can be controlled by the intelligent control system to start and stop the inhibitor nozzle. When the inhibitor nozzle is started, the inhibitor is sprayed out to the wellhead of the exploiting pipe to inhibit the secondary hydrate formation at the bottom of the well. When the inhibitor nozzle is stopped, the excess inhibitor flows to the inhibitor recovery bin.

The beneficial effect of the present invention is that the exploiting method can realize automatic operation and remote control, effectively preventing the sand production of the exploiting pipe, improving the permeability around the exploiting pipe and inhibiting the secondary hydrate formation in the exploiting pipe, realizing stable depressurized exploiting, improving the exploiting efficiency and the recovery of high concentration natural gas.

1. Boundary of production unit; 2. Sea water layer; 3. Upper mud layer; 4. Hydrate layer; 5. Lower mud layer; 6. Self-excited oscillating jet nozzle; 7. Horizontal exploiting pipe; 8. Fixed pipe; 8-1. fixed pipe outer layer; 8-2. fixed pipe inner layer; 9. Orifice; 10. Hydrophobic porous material; 11. Artificial fractures; 12. Hydraulic jet hose; 13. Inhibitor recovery bin; 14. Inhibitor nozzle; 15 Temperature sensor; 16. Pressure sensor; 17. Temperature rise device; 18. Liquid outlet; 19. Gas outlet; 20. Gas-liquid separation device; 21. Booster chamber; 22. Vertical well; 23. Hydrophobic porous material bin; 24. Inorganic permeable concrete reinforcing agent tank; 25. Abrasive buffer tank; 26. Hydraulic booster; 27. Offshore platform; 28. Intelligent control system; 29. Gas-liquid flow direction.

DETAILED DESCRIPTION OF THE EMBODIMENTS

The following embodiments are a further description of the present invention, rather than a limitation of it.

Unless otherwise specified, the equipment and materials mentioned in the present invention are all commercially available. SR-inorganic permeable concrete reinforcing agent was purchased from Nanjing Jiajing.

Embodiment 1

Figure 1:
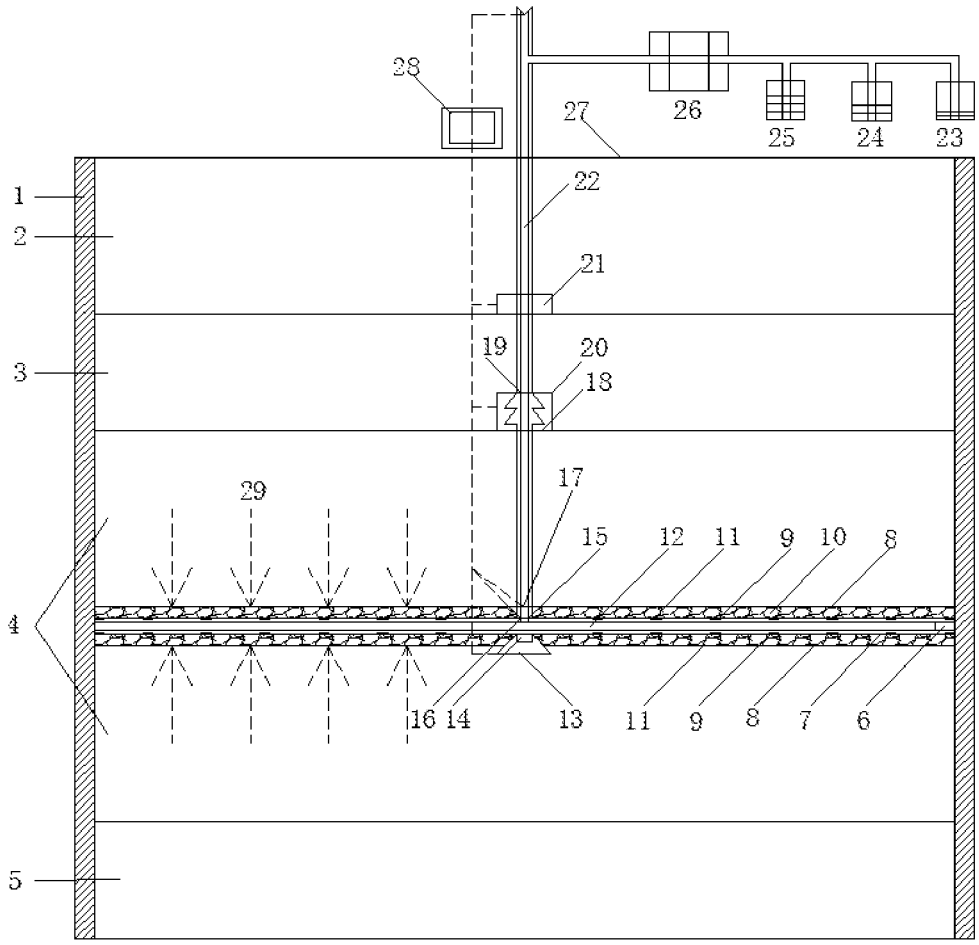
FIG. 1 is a structure diagram of an exploiting device of marine facies natural gas hydrate of the present invention, and the dotted line arrow in the diagram is the gas-liquid flow direction.
Figure 2:
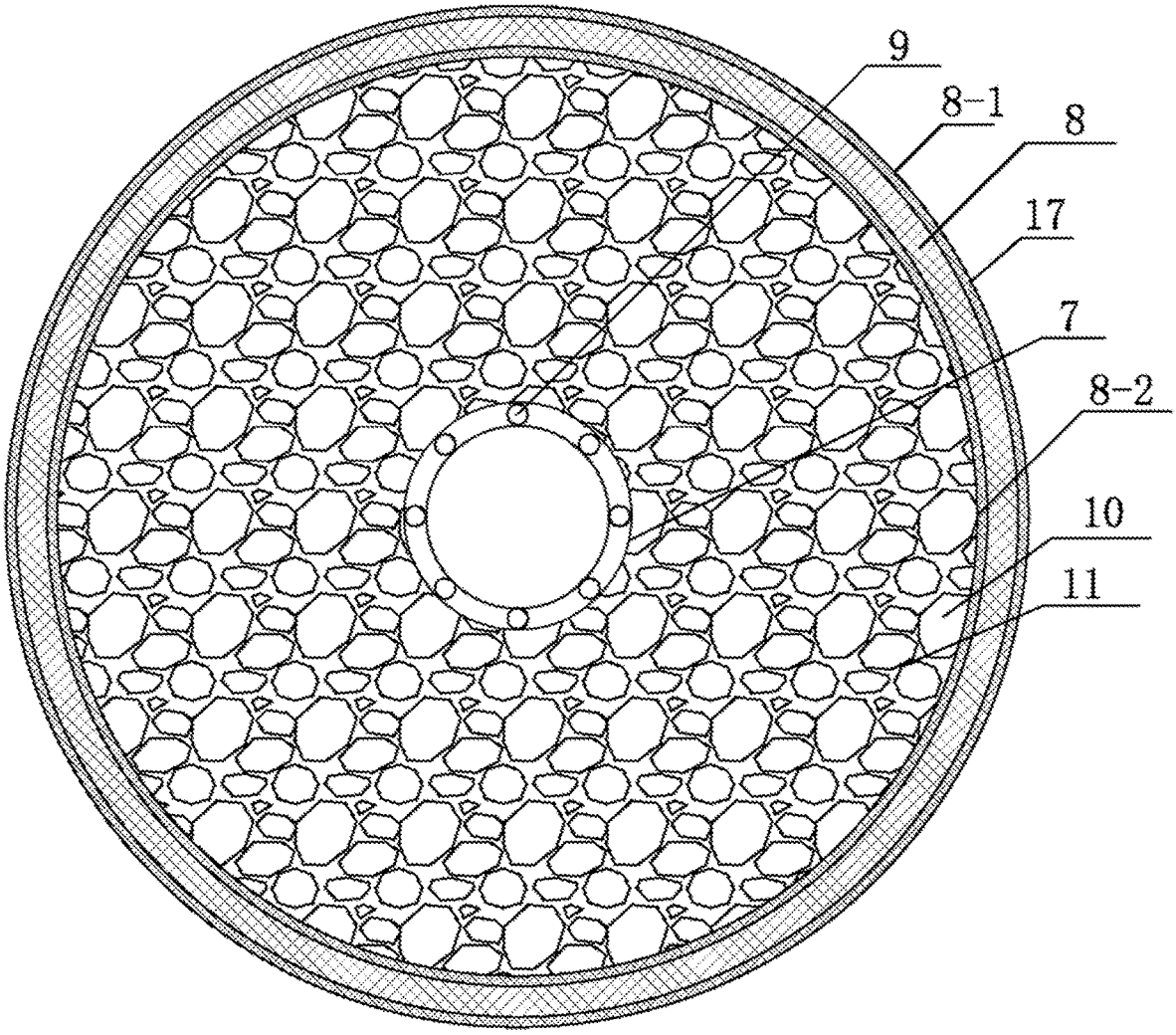
FIG. 2 is a structural diagram of the longitudinal section of the fixed pipe in FIG. 1.

As shown in FIG. 1 and FIG. 2, when exploiting a hydrate production area, the boundary of production unit 1 is determined first. The production unit is divided into sea water layer 2, upper mud layer 3, hydrate layer 4 and lower mud layer 5 from top to bottom. The gas-liquid flow direction of hydrate 29 is shown in FIG. 1.

The exploiting device of marine facies natural gas hydrate comprises an artificial sand control well wall system, a hydraulic jet permeability enhancement system, a depressurized exploiting system and a gas-liquid separation control system; an artificial sand control well wall system comprises a fixed pipe 8 buried in a hydrate layer 4, a hydraulic jet permeability enhancement system comprises a water jet hose 12, a self-excited oscillating jet nozzle 6 and jet abrasive stored in an abrasive buffer tank 25; the depressurized exploiting system comprises a vertical well 22, an exploiting pipe arranged in the center of the fixed pipe 8, a temperature rise device arranged outside the fixed pipe 8 and an inhibitor circulation device arranged outside the fixed pipe 8. The mixture of hydrophobic porous material and inorganic permeable concrete reinforcing agent is filled between the inner wall of the fixed pipe and the outer wall of the exploiting pipe. The inhibitor circulation device comprises an inhibitor nozzle 14 arranged outside the exploiting pipe and the inhibitor recovery bin 13 arranged outside the fixed pipe 8, a self-excited oscillating jet nozzle 6 enters the exploiting pipe of the fixed pipe 8 along the vertical well 22 to the designated position and sprays the mixture through the orifice 9 (e.g., port, opening) of the exploiting pipe, so that the mixture can be broken evenly, forming artificial fractures; a gas-liquid separation control system comprises a gas-liquid separation device 20, a gas booster chamber 21 and an intelligent control system 28 which determines the start and stop of the temperature rise device 17 and the inhibitor circulation device according to the conditions of the temperature sensor 15 and the pressure sensor 16 arranged outside the fixed pipe 8.

The exploiting pipe can be set as a vertical exploiting pipe or a horizontal exploiting pipe according to the actual exploiting location. The gas-liquid separation device 20 is a device that can realize the gas-liquid separation of hydrate. In this embodiment, the preferred exploiting pipe is a horizontal exploiting pipe 7. The preferred gas-liquid separation device 20 is a separator with centrifugal force separation and flow separation structure. The gas-liquid mixture extracted from the horizontal exploiting pipe 7 is separated in the separation device 20 to obtain liquid and gas, and the liquid is discharged from the liquid outlet 18 to the upper mud layer 3. The gas is discharged from the gas outlet 19 along the vertical well 22 to the gas booster chamber 21. When the pressure is higher than the set pressure, the gas rises to the offshore platform 27 to complete gas collection. The outer part of the horizontal exploiting pipe 7 is provided with an inner filter screen to prevent the mixing of extremely fine particles into the horizontal exploiting pipe 7 and an outer filter screen to prevent the mixing of large particles into the horizontal exploiting pipe 7. The horizontal exploiting pipe 7 is provided with an orifice 9 for the inflow of gas-liquid mixture. The outer part of the fixed pipe 8 is provided with a fixed pipe outer layer 8-1 and a fixed pipe inner layer 8-2. The fixed pipe outer layer 8-1 of the fixed pipe is evenly arranged with I-beam made from steel, which is to prevent the large particles from mixing into the fixed pipe, and the fixed pipe inner layer 8-2 of the fixed pipe is a filter screen to prevent the extremely fine particles from mixing into the fixed pipe 8. In this embodiment, the temperature rise device 17 is a heating wire, which is uniformly arranged on the outer layer of the fixed pipe 8. When the corresponding point of the temperature and pressure measured by the temperature sensor 15 and the pressure sensor 16 is under the level of the natural gas hydrate phase equilibrium, the heating wire heats the outer layer of the fixed pipe 8 continuously to break the hydrate formed on the outer layer of the fixed pipe 8, ensuring that the gas enters the exploiting pipe 7 from the orifice 9 of the exploiting pipe 7.

The hydrophobic porous material is diatomite, aerogel or foam alloy, and the mass ratio of hydrophobic porous material and inorganic permeable concrete reinforcing agent is 1000:1-10:1. Hydrophobic porous materials have no affinity to water, and gather into blocks in water. Inorganic permeable concrete reinforcing agent reacts with hydrophobic porous materials to form polymer hydrate which is not easy to be dispersed by water, which greatly improves the compressive strength and adhesive strength of hydrate, and enhances the freeze-thaw resistance, durability and weather resistance of hydrophobic porous materials.

The fixed pipe 8 is buried in the hydrate layer 4 in advance, and the horizontal exploiting pipe 7 is set in the fixed pipe 8. The hydrophobic porous material 10 from the hydrophobic porous material bin 23 is mixed with the inorganic permeable concrete reinforcing agent from the inorganic permeable concrete reinforcing tank 24, the mixture is acted by the hydraulic booster 26, and then enters and fills between the outer wall of the horizontal exploiting pipe 7 and the inner wall of the fixed pipe 8 through the vertical well 22. The hydrophobic porous material 10 is adhesive formed under the action of inorganic permeable concrete reinforcing agent; the abrasive of the abrasive buffer tank 25 is sprayed under a high pressure through the self-excited oscillating jet nozzle 6 under the action of constant pressure and constant speed pump on the adhesive formed hydrophobic porous material in the fixed pipe 8, and the self-excited oscillating jet nozzle 6 is connected with the hydraulic jet hose 12 to realize the directional moves of the self-excited oscillating jet nozzle 6 in the fixed pipe 8 and the horizontal exploiting pipe 7 to the designated position to spray the hydrophobic porous material 10 according to the demand, so that the hydrophobic porous material 10 which is adhesive formed with the inorganic permeable concrete reinforcing agent can be broken evenly to form artificial fractures 11; the start and stop of the inhibitor nozzle 14 of the inhibitor circulation device can be controlled by the intelligent control system 28, when the inhibitor nozzle 14 is started, the inhibitor is sprayed out to the wellhead of the exploiting pipe to inhibit the secondary hydrate formation at the bottom of the well. When inhibitor nozzle 14 is stopped, the redundant inhibitor flows to inhibitor recovery bin 13.

The method of exploiting natural gas hydrate from marine rock comprises the following steps:

(1) when exploiting a hydrate production area, the construction of a vertical well is completed first by drilling technology, and then the horizontal fixed pipe is constructed after reaching the middle of the hydrate layer. The diameter of the horizontal fixed pipe is determined according to the seepage conditions of the hydrate layer. The constructed fixed pipe is filled with a mixture of hydrophobic porous material and inorganic permeable concrete reinforcing agent, the mass ratio of hydrophobic porous material and inorganic permeable concrete reinforcing agent in the mixture of hydrophobic porous material and inorganic permeable concrete reinforcing agent is 1000:1-10:1. They are evenly mixed to fill the inner wall of the fixed pipe and the outer wall of the horizontal exploiting pipe and adhesive formed. The purpose of this step is to use the pores of hydrophobic porous material to discharge the gas and liquid produced by decomposing to block the sea mud outside the fixed pipe; the horizontal exploiting pipe is arranged in the middle of the hydrophobic porous material inside the fixed pipe, the horizontal exploiting pipe is divided into two layers: an inner layer and an outer layer. Both of them are equipped with fine mesh and orifices. The fine mesh prevents the very fine particles from mixing into the horizontal exploiting pipe. The orifice is used for the inflow of gas and liquid into the artificial sand control well wall;

(2) Artificial sand control well wall with hydraulic jet permeability enhancement: the self-excited oscillating jet nozzle enters the exploiting pipe with a fixed pipe along the vertical well to the designated position through the orifice on the exploiting pipe and sprays the mixture, so as to break the glued mixture evenly and form artificial fractures. The artificial fractures are to improve the permeability around the exploiting pipe and improve gas production efficiency.

(3) Depressurized exploiting: under the corresponding temperature, when the exploiting pressure is lower than the natural gas hydrate phase equilibrium pressure, the hydrate decomposes to produce gas. As the temperature around the hydrate is decreased due to the decomposition process, the natural gas hydrate phase equilibrium pressure is also decreased, which leads to the secondary hydrate easily appearing in the exploiting pipe and on the fixed pipe wall, resulting in the blockage of the pipe body. An intelligent control system judges the start and stop of a temperature rise device and an inhibitor circulation device according to the conditions of a temperature sensor and a pressure sensor. When the corresponding point of the temperature and pressure measured by the temperature sensor and the pressure sensor is under the level of the natural gas hydrate phase equilibrium, the temperature rise device and inhibitor circulation device start automatically. The temperature rise device heats the outer layer of the fixed pipe continuously. The inhibitor nozzle in the inhibitor circulation device sprays out the inhibitor to the wellhead of the exploiting pipe to inhibit the secondary hydrate formation on the outer layer of the fixed pipe and at the bottom of the well;

(4) Gas liquid separation: the gas-liquid mixture extracted from the horizontal exploiting pipe is separated in the gas-liquid separation device to obtain liquid and gas. The liquid is discharged from the discharge port to the upper mud layer and the gas is discharged from the gas outlet along the vertical well to the gas booster chamber. When the pressure is higher than the set pressure, the gas rises to an offshore platform to complete gas collection.

Embodiment 2

According to the exploiting method and device of marine facies natural gas hydrate in the Embodiment 1, the hydrate reservoir is exploited. The hydrophobic porous material is diatomite, aerogel or foam alloy, and the mass ratio of hydrophobic porous material and inorganic permeable concrete reinforcing agent is 1000:1-10:1. In this embodiment, the hydrophobic porous material is diatomite, and the inorganic permeable concrete reinforcing agent is SR-inorganic permeable concrete reinforcing agent. The mass ratio of hydrophobic porous material and inorganic permeable concrete reinforcing agent is 100:1, and the exploiting pressure is 3 MPa. After the gas-liquid mixture generated by hydrate separation enters the horizontal well, the gas is discharged from the outlet along the vertical well to the gas booster chamber. When the pressure is higher than the set pressure, the gas is exploited from the vertical well to complete gas collection. The natural gas concentration obtained by the exploiting method of this embodiment is high, the gas production rate is more than 4 times of the gas production rate of the prior art (the artificial sand control well wall of the Embodiment 1 was not used).

The above is a detailed introduction given to the exploiting method and device of marine facies natural gas hydrate provided by the present invention. The above description of the embodiments is only used to help understand the technical scheme and the core idea of the present invention. It should be pointed out that for those skilled in the art, the present invention can be improved and modified without departing from the principle of the invention, these improvements and modifications also fall into the protection scope of the claims of the present invention.

What is claimed is:

1. A method of exploiting natural gas hydrate from marine rock, comprising the following steps:

positioning a vertical well to contact a hydrate layer, wherein a fixed pipe is connected to the vertical well and positioned in the hydrate layer, wherein an exploiting pipe is positioned in a center of the fixed pipe, and wherein an annulus between an inner wall of the fixed pipe and an outer wall of the exploiting pipe is filled with an adhesive mixture of a hydrophobic porous material and an inorganic permeable concrete reinforcing agent;

inserting a self-excited oscillating jet nozzle into an orifice in the exploiting pipe within the fixed pipe to a designated position, the nozzle being configured to spray the mixture to break the mixture and form a plurality of artificial fractures in the mixture;

triggering an intelligent control system comprising a temperature rise device and an inhibitor circulation device when a corresponding point of a temperature and pressure measured by a temperature sensor and a pressure sensor is under a level of a natural gas hydrate phase equilibrium, wherein the temperature rise device is configured to heat an outer layer of the fixed pipe and an inhibitor nozzle in the inhibitor circulation device is configured to spray out an inhibitor to inhibit a secondary hydrate formation on the outer layer of the fixed pipe and within the exploiting pipe when the intelligent control system is triggered;

collecting a gas rising to an offshore platform, wherein a gas-liquid mixture extracted from the exploiting pipe is separated in a gas-liquid separation device to obtain liquid and gas, wherein a liquid from the gas-liquid mixture is discharged from a discharge port to an upper mud layer and gas from the gas-liquid mixture is discharged from a gas outlet along the vertical well to a gas booster chamber, and wherein when the pressure is higher than a set pressure, the gas rises to the offshore platform to complete gas collection.

2. The method of exploiting natural gas hydrate from marine rock according to claim 1, wherein a mass ratio of the hydrophobic porous material and the inorganic permeable concrete reinforcing agent in the mixture of the hydrophobic porous material and the inorganic permeable concrete reinforcing agent is 1000:1-10:1.

3. A device for exploiting natural gas hydrate from marine rock comprising a vertical well connected to a fixed pipe buried in a hydrate layer, an exploiting pipe arranged in the center of the fixed pipe, a self-excited oscillating jet nozzle arranged in the exploiting pipe, a temperature rise device, and an inhibitor circulation device arranged outside the fixed pipe, wherein the inhibitor circulation device comprises an inhibitor nozzle arranged outside the exploiting pipe and an inhibitor recovery bin arranged outside the fixed pipe, and the self-excited oscillating jet nozzle is configured to spray a mixture to break the mixture and form a plurality of artificial fractures in the mixture;

a gas-liquid separation control system comprises a gas-liquid separation device, a gas booster chamber and an intelligent control system, wherein the intelligent control system is configured to start and stop the temperature rise device and the inhibitor circulation device based on temperature and pressure conditions sensed by a temperature sensor and a pressure sensor arranged outside the fixed pipe, the gas-liquid separation device is configured to separate a gas-liquid mixture extracted from the exploiting pipe to obtain liquid and gas, wherein the liquid is discharged from a discharge port to an upper mud layer and the gas is discharged from a gas outlet along the vertical well to the gas booster chamber, and wherein when the pressure is higher than a set pressure, the gas rises to an offshore platform to complete gas collection.

4. The device for exploiting natural gas hydrate from marine rock according to claim 3, wherein an inner layer filter screen and an outer layer filter screen are arranged outside the exploiting pipe to prevent a plurality of fine particles from entering mixing into the exploiting pipe, and the inner layer filter screen and the outer layer filter screen are both provided with a plurality of orifices for an inflow of the gas-liquid mixture.

5. The device for exploiting natural gas hydrate from marine rock according to claim 4, wherein the temperature rise device is a heating wire, wherein the heating wire arranged on the outer layer of the fixed pipe, and wherein when the corresponding point of the temperature and pressure measured by the temperature sensor and the pressure sensor is less than the level of the natural gas hydrate phase equilibrium, the heating wire is configured to heat the outer layer of the fixed pipe to break the hydrate formed on the outer layer of the fixed pipe.

6. The device for exploiting natural gas hydrate from marine rock according to claim 3, wherein the inner wall of the fixed pipe and the outer wall of the exploiting pipe is filled with the mixture, the mixture comprising hydrophobic porous material and an inorganic permeable concrete reinforcing agent.

* * * * *